United States Patent [19]

Wynn

[11] Patent Number: 4,887,510

[45] Date of Patent: Dec. 19, 1989

[54] RECOIL LOCKING SYSTEM FOR A FIREARM

[76] Inventor: Richard R. Wynn, 3600 Lake Crest Dr., SW., Knoxville, Tenn. 37920

[21] Appl. No.: 284,937

[22] Filed: Dec. 15, 1988

[51] Int. Cl.[4] ..... F41C 21/22; F41C 27/00

[52] U.S. Cl. ..... 89/163; 89/196

[58] Field of Search ..... 89/163, 196, 194, 195, 89/197

[56] References Cited

U.S. PATENT DOCUMENTS

| | | | |
|---|---|---|---|
| 747,585 | 12/1903 | Browning . | |
| 808,003 | 12/1905 | Browning | 89/163 |
| 818,739 | 4/1906 | Browning | 89/163 |
| 1,333,570 | 3/1920 | Pedersen | 89/196 |
| 2,489,816 | 11/1949 | Reilly | 42/75 |
| 3,411,406 | 11/1968 | Pachmayr et al. | 89/196 |
| 3,901,125 | 8/1975 | Raville | 89/163 |
| 3,975,982 | 8/1976 | Terstegge | 89/196 |
| 4,409,882 | 10/1983 | Blackshaw et al. | 89/163 |
| 4,522,107 | 6/1985 | Woodcock et al. | 89/196 |
| 4,608,909 | 9/1986 | Peters | 89/196 |

FOREIGN PATENT DOCUMENTS

| | | | |
|---|---|---|---|
| 1041390 | 10/1957 | Fed. Rep. of Germany | 89/196 |
| 363872 | 8/1906 | France | 89/163 |
| 637124 | 4/1928 | France | 89/163 |
| 9871 | 7/1897 | United Kingdom | 89/195 |

*Primary Examiner*—Deborah L. Kyle
*Assistant Examiner*—Stephen Johnson
*Attorney, Agent, or Firm*—Luedeka, Hodges & Neely

[57] ABSTRACT

A fireman having a recoil spring, a recoil spring plug and a barrel bushing for directing and transferring recoil forces from a slide to a slide-supporting receiver of the firearm utilizes a lockplate inserted transversely through the slide and interposed between the barrel bushing and the recoil spring plug. The lockplate maintains the recoil spring plug and barrel bushing within the slide and allows transference of recoil forces from the slide to the recoil spring. The slide defines a through-aperture and both the barrel bushing and the recoil spring plug define a slot positionable in registry with the slide through-aperture so as to define an opening extending transversely through the firearm. The recoil spring plug is movable forwardly and rearwardly to a limited extent relative to the slide, and when the recoil spring plug is depressed in its rearward position and the barrel bushing is rotated into appropriate registry with the slide, the lockplate is insertable through the defined through-opening. When the recoil spring is released to its forward position, the lockplate is prevented from being withdrawn from the through-opening, thus securely locking both the barrel bushing and the recoil spring plug within the slide. This configuration resists catastrophic failure due to shear during the operation of the firearm.

4 Claims, 2 Drawing Sheets

RECOIL LOCKING SYSTEM FOR A FIREARM

BACKGROUND AND SUMMARY OF THE INVENTION:

This invention relates generally to semi-automatic firearms and relates more particularly to the means by which recoil components are retained within the firearm.

The type of firearm with which this invention is concerned includes a receiver, a slide mounted upon the receiver for reciprocating movement relative thereto between forward and rearward limits of travel, and a barrel positioned within the slide. A barrel bushing is interposed between the slide and the barrel for movement with the slide during reciprocating movement thereof. A recoil spring is connected between the receiver and the slide for urging the slide to its forward limit of travel, and a recoil spring plug is interposed between the spring and the slide for holding one end of the spring within the slide and so that forces, such as those generated by the firing of a cartridge within the firearm and utilized to move the slide toward its rearward limit of travel are transferred from the slide to the recoil spring through and contained by the recoil spring plug. Moreover, the recoil spring plug is movable relative to the slide between a rearward position at which disassembly of the firearm is facilitated and a forward position at which the firearm is ready for firing. An example of a firearm of the aforedescribed type is available under the trade designation Colt MK IV/Series 80 Government Model from Colt's P.T. F.A. Mfg. Co., Hartford, Conn..

When a firearm of the aforedescribed type is discharged, the explosive gases generated within the barrel suddenly urge the slide from its forward limit of travel toward its rearward limit of travel so that a relatively large amount of force is suddenly transferred from the slide to the recoil spring and to the recoil spring plug. In the referenced Colt firearm as manufactured heretofore, the recoil spring plug includes a projecting lug which is received within a slot defined within the slide so that a substantial amount of slide-moving forces which are transferred from the slide to the recoil spring plug are passed to the projecting lug. It has been found that the projecting lug is susceptible to shearing off during the transfer of such slide-moving forces so that the recoil spring plug loses its spring-holding capacity and at times literally is projected out of the slide with considerable force and possibly endangering the user or others.

The recoil spring plug is a hollow cylinder having one open end and one closed end for containing one end of the recoil spring. To avoid excessive protrusion of one end of the recoil spring plug beyond the barrel and the barrel bushing at the muzzle end of the firearm and to prevent the end of recoil spring plug opposite its protruding end from hitting the receiver, the overall length of the spring recoil plug is limited to a length just slightly longer than that of the recoil spring when fully compressed. This full compression of the recoil spring occurs when the slide is in its rearward limit of travel. To accommodate the full spring compression, the wall thickness of the closed end of the recoil spring plug is minimized.

Further, the wall thickness of the barrel bushing and the recoil spring plug are on the order of a couple of a tenths of an inch due to the necessity of conserving sufficient space to permit the barrel to be flared or cone-shaped at the muzzle end. This minimized wall thickness is largely responsible for the failure of the recoil spring plug and the barrel bushing when subjected to the recoil forces encountered in the larger calibers that are found in this type of pistol. This overall design places severe limitations upon the possible engineering techniques available for securing the barrel bushing and recoil spring plug in their respective positions while still providing for the desired "tool-less" field stripping as has become traditional for this type of firearm.

It is recognized that cylindrical pins, for example, have been used heretofore to anchor the recoil spring plug in the slide. Such pins and screws, however, tend to work their way out of their locking positions during firing of the weapon. In the present firearm, in any event, such pins are not usable due to the lack of sufficient space. Specifically, because the recoil spring is received within the recoil spring plug, it is not possible to insert a pin through the plug inasmuch as such pin would obstruct the recoil spring and its action. A cylindrical pin that possesses sufficient strength to not be sheared upon recoil of the slide is too large to be positioned between the barrel bushing and the recoil spring plug while permitting clearance for the barrel within the barrel bushing and for the recoil spring within the recoil spring plug, due to the thin walls of the barrel bushing and recoil spring plug. Additionally, a screw mounted through the forward (i.e., muzzle) end of the recoil spring plug tends to unthread itself due to recoil impact and torque.

It is an object of the present invention to provide a new improved system for locking the recoil components of a firearm of the aforedescribed type into place.

Another object of the present invention is to provide such a system utilizing components wherein the likelihood of failure, such as shear failure, of the components during use of the firearm is relatively small.

Still another object of the present invention is to provide such a system wherein the likelihood of a system component accidentally dislodging itself from its operative position within the firearm is relatively small.

Yet another object of the present invention is to provide such a system utilizing components which are relatively easy to assemble and disassemble.

A further object of the present invention is to provide such a system having components which can be manufactured economically.

A still further object of the present invention is to provide such a system which is uncomplicated in construction and effective in use.

In one aspect of the present invention, the slide defines a transversely-extending through-aperture and each of the recoil spring plug and barrel bushing defines a transversely-extending slot which is positioned in registry with the slide through-aperture so as to provide a transversely-extending through-opening in the firearm when the recoil spring plug is positioned in either one of its limited rearward and forward positions. The firearm also includes an elongated lockplate member insertable endwise within the defined through-opening when the recoil spring plug is depressed to its rearward position for securing the recoil spring plug within the slide and which cooperates with the recoil spring plug so that the lockplate member is prevented from being moved endwise along and out of the through-opening when the recoil spring plug is released to its limited forward position.

In another aspect of the invention, the transversely-extending through-opening in the firearm is collectively provided by a though-aperture defined in the slide and slots defined in the recoil spring plug and the barrel bushing. When inserted within the through-opening, the lockplate member is in position to transfer energy utilized to shift the slide toward its rearward limit of travel to the recoil spring plug by way of the slide and barrel bushing.

DETAILED DESCRIPTION OF THE ILLUSTRATED EMBODIMENT

Figure 1:
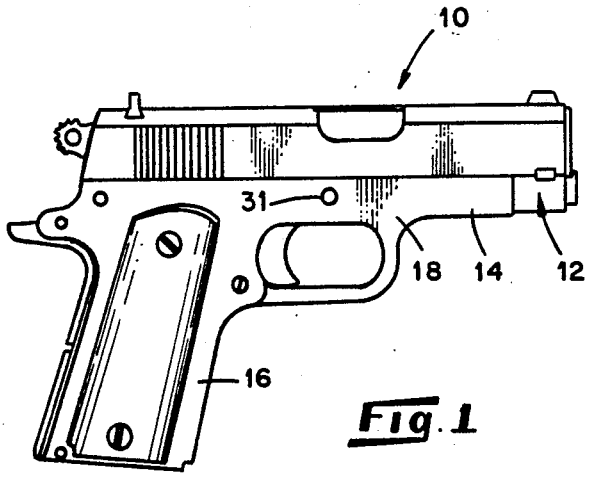
FIG. 1 is a side elevation view of a firearm embodying the system in accordance with the invention.
Figure 2:
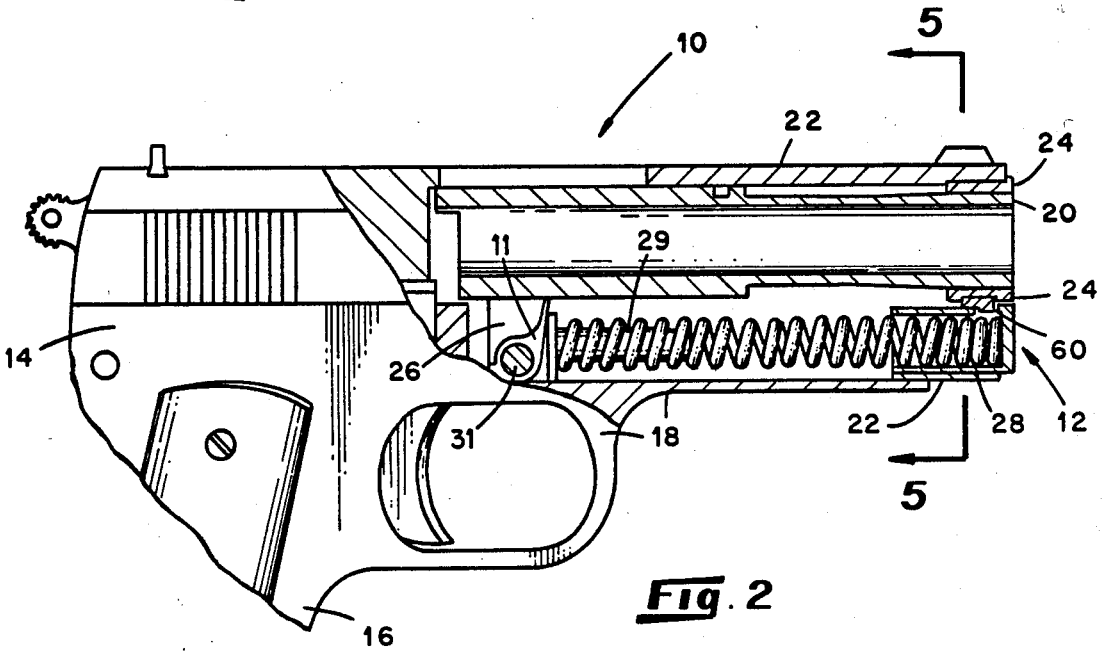
FIG. 2 is a fragmentary view, shown partially in section, of the FIG. 1 firearm.

Turning now to the drawings and considering first FIGS. 1 and 2, there is illustrated in greater detail a firearm, generally indicated 10, within which an embodiment of the locking system, generally indicated 12, in accordance with the present invention is incorporated. The firearm 10 includes a receiver 14 having a stock 16 within which is positioned a cartridge magazine (not shown) and a barrel-supporting section 18 upon which a barrel 20 is supported. The barrel 20 is slidably mounted within a slide 22 which is, in turn, slidably mounted upon the receiver section 18 for reciprocating movement relative thereto between forward and rearward limits of travel in a manner well-known in the art. The barrel 20 is fixedly mounted relative to the receiver 14, and the slide 22 slidably moves along the length of the barrel 20 when the slide 22 is moved between its forward and rearward limits of travel.

To ready the firearm for firing, the slide 22 is forced rearwardly to its rearward limit of travel so that a cartridge from the magazine moves into the breech, and the slide 22 is subsequently returned to its forward limit of travel. Upon discharge of the firearm 10, the explosive force of the cartridge positioned within the barrel 20 propels the slide 22 toward its rearward limit of travel for the purposes of ejecting the spent cartridge and automatically replacing the spent cartridge with another cartridge from the magazine.

Figure 3:
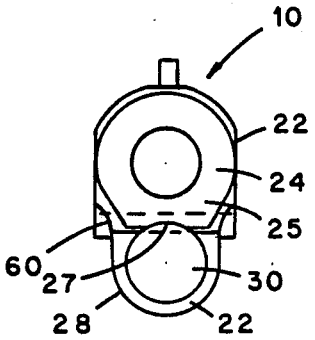
FIG. 3 is a front elevation view of the forward end of the FIG. 1 firearm as seen from the right in FIG. 2.

With reference to FIGS. 2 and 3, a barrel bushing 24 is interposed between the slide 22 and the barrel 20 at the forwardly-directed end of the barrel 20 and is keyed to the slide 22 in a manner described herein so that the barrel bushing 24 moves with the slide 22 during its reciprocating movement. The barrel bushing 24 includes a main cylindrical portion terminating at a forward-facing flange 25 having a radially outwardly-opening U-shaped portion 27. When the firearm 10 is desired to be disassembled and the barrel 20 removed from the slide 22, the barrel bushing 24 is unlocked from the slide 22 and withdrawn from the forward end thereof.

With reference still to FIG. 2, the barrel 20 includes a downwardly-depending lug 26 adjacent its rearwardly-directed end which is fixed to the receiver 14 by means of a stop pin 31 so that the barrel 20 is allowed to pivot on a barrel link 11 diagonally in a limited forwardly and rearwardly direction relative to the receiver 14. The slide 22 includes a sleeve-like portion 23 positioned generally beneath the barrel 20 at the forward end of the slide 22 and there is mounted within the sleeve-like portion 28 a spring recoil plug 30 and a compression-type recoil spring 32 for acting between the receiver 14 and slide 22. More specifically, the recoil spring 32 has a rearwardly-directed end which is guided against the barrel lug 26 and another end which is captured within the recoil spring plug 30 which is, in turn, locked to the sleeve-like portion 28 of the slide 22 in accordance with the present invention. The spring 32 is sized so as to continually act against the receiver 14 and urge the slide 22 toward its forward limit of travel. It follows that the spring 32 is moved to a compressed condition when the slide 22 is moved to its rearward limit of travel and returns the slide 22 to its forward limit of travel once the forces responsible for shifting the slide 22 to its rearward limit of travel are relieved therefrom.

Figure 4:
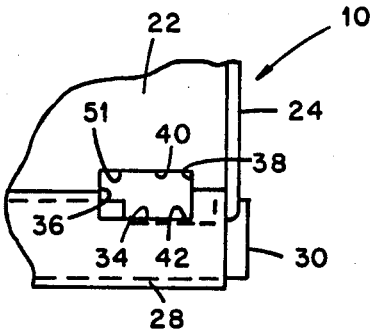
FIG. 4 is a view of a fragment of the FIG. 1 firearm as seen in FIG. 1 but drawn to a slightly larger scale and having the lockplate member removed therefrom.
Figure 5:
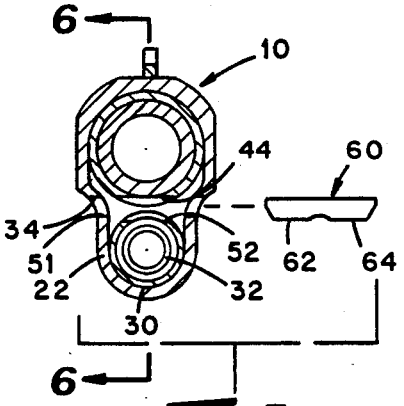
FIG. 5 is a cross-sectional view, shown exploded, taken about on lines 5—5 of FIG. 2.

In accordance with the system of the present invention and with reference to FIGS. 4 and 5, the slide 22 defines a transversely-extending through-aperture 34 adjacent its forward end. The through-aperture 34 is generally rectangular in cross section as viewed in FIG. 4 and its walls are provided by portions of the slide 22 which are positioned on opposite sides of the firearm 10 as best shown in FIG. 5. With reference again to FIG. 4, the through-aperture 34 defines opposing forwardly and rearwardly-facing planar walls 36, 38, respectively, and opposing downwardly and upwardly-facing planar walls 40, 42, respectively.

Figure 6:
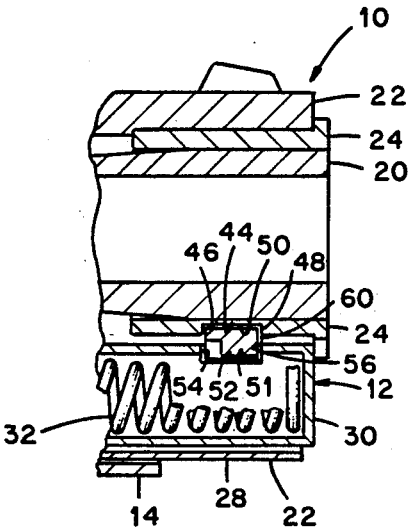
FIG. 6 is a cross-sectional view taken about on lines 6—6 of FIG. 5 and illustrating the recoil spring plug when positioned in its rearward position.
Figure 7:
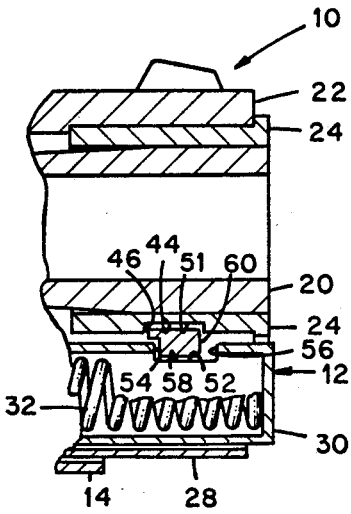
FIG. 7 is a view similar to that of FIG. 6 illustrating the recoil spring plug when positioned in its forward position.

With reference to FIGS. 5–7, the barrel bushing 24 defines a transversly-extending slot 44 in its cylindrical outer surface which is positioned in registry with the slide through-aperture 34 when the barrel bushing 24 is operatively positioned within the slide 22. More specifically, the slot 44 defines opposite forwardly and rearwardly-facing planar walls 46 and 48, respectively, and a downwardly-facing planar wall 50 intermediate of and joining the walls 46 and 48, and when the bushing slot 44 is positioned in registry with the through-aperture 34, the forwardly-facing walls 36 (FIG. 4) and 46 (FIG. 6) are coplanar, rearwardly-facing walls 38 and 48 are coplanar and downwardly-facing walls 40 and 50 are coplanar.

With reference still to FIGS. 5–7, the recoil spring plug 30 is generally cylindrical in shape and defines a central bore opening out of the rearward end thereof and which extends for a substantial distance along the length of the recoil spring plug 30. In accordance with the present invention, the recoil spring plug 30 defines a slot 52 within its cylindrical surface, which slot 52 communicates with the central bore and has opposite forwardly and rearwardly-facing walls 54, 56, respectively, and upwardly-facing walls 58. The recoil spring plug 30 is of such size and shape to be slidably received endwise within the sleeve-like portion 28 of the slide 22, as best shown in FIG. 2, so that sliding movement of the recoil spring plug 30 forwardly and rearwardly with respect to the slide 22 is permitted. When the recoil spring plug 30 is operatively depressed in its rearward position relative to the slide 22, as illustrated in FIG. 6, the plug slot 52 is positioned in registry with the slide through-aperture 34 so that the forwardly-facing walls 36 (FIG. 4) and 54 (FIG. 6) are coplanar, the rearwardly-facing walls 38 and 56 are coplanar and the upwardly-facing walls 42 and 58 are coplanar.

It follows from the foregoing that when the bushing slot 44 is positioned in registry with the slide through-aperture 34 and the recoil spring plug slot 52 is positioned in the FIG. 6 position, the cross section of the through-opening, indicated 51, collectively defined by the slots 44, 52, and through-aperture 34 is substantially rectangular in shape for the entire length of the through-opening 51. It also follows that when the recoil spring plug 30 is positioned in its FIG. 7 position, a portion of the recoil spring plug 30 or, in particular, a section of the cylindrical plug surface which extends generally rearwardly of the forwardly-facing slot wall 54 of the recoil spring plug 30 extends into the through-opening 51 so as to alter and reduce in size the cross-sectional shape thereof through the central section of the through-opening 51. More specifically, movement of the recoil spring plug 30 from its FIG. 6 rearward position to its FIG. 7 forward position changes the cross-sectional shape of the through-aperture 51 from rectangular to somewhat L-shaped.

Furthermore, the recoil spring plug 30 is positionable along the length of the slide 22 is that when the recoil spring plug 30 is positioned in its forward, or FIG. 7 position, the forward end of the recoil spring plug 30 is received by the opening defined in the "U" of the bushing flange 25. Conversely and when the recoil spring plug 30 is positioned or depressed in its rearward, or FIG. 6 position, the forward end of the recoil spring plug 30 is retracted from the "U" of the bushing flange 25.

Figure 8:
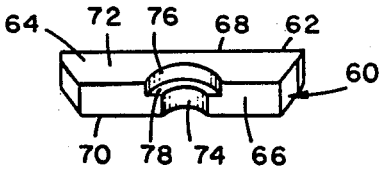
FIG. 8 is a perspective view of the lockplate member of the FIG. 1 firearm.

In accordance with the present invention and with reference to FIGS. 2, 3, 5, 6, 7 and 8, the system 12 includes an elongated lockplate member 60 adapted to be positioned within the transversly-extending through-opening 51 defined by the bushing slot 44, the recoil spring plug slot 52 and the slide through-aperture 34 when the recoil spring plug 30 is positioned in its FIG. 6 rearward position to thereby lock the barrel bushing 24 and the recoil spring plug 30 within the slide 22. The lockplate member 60 defines two opposite end portions 62, 64 which each terminate at an end which has been contoured to correspond generally to the contour of a corresponding side of the slide 22 and has a length as measured between its ends which is about equal to the width of the slide 22 in the vicinity of the through-aperture 34. Furthermore, the lock plate member 60 is provided with a substantially rectangular cross-sectional shape for a substantial distance along its length. Defined about the lockplate member 60 is a downwardly-facing planar surface 66, an upwardly facing planar surface 68, and two opposite and parallel planar forwardly and rearwardly-facing surfaces 70 and 72, respectively. Positioned intermediate of the end portions 62, 64 is a central portion which is notched in a stepped pattern, as viewed in FIG. 8, so that the downwardly-facing surface 66 defines a groove 74 having arcuate walls as shown in FIG. 8 extending rearwardly from the forwardly-facing surface 70. Furthermore, the member surfaces 66 and 72 collectively define a notch 76 having arcuate walls extending forwardly from the rearwardly-directed surface 72 and rearwardly-facing shoulder or surface 78. The rearwardly-facing surfaces 72 and 78 of the lockplate member 60 are parallel to one another.

With reference to FIG. 5, the lockplate member 60 is of such size and shape to be operatively inserted endwise within the through-opening 51 when the recoil spring plug 30 is positioned in its FIG. 6 rearward position so that the member 60 is substantially centered between the opposite sides of slide 22.

Once the lockplate member 60 is centered within the through-aperture 51, due to the constant pressure of the recoil spring 32, the recoil spring plug 30 is shifted to its FIG. 7 forward position so that a portion of the recoil spring plug 30 is received by the notch 76 of the lockplate member 60 and so that the forwardly-facing surface 54 of the plug slot 52 engages the rearwardly-facing surface 78 of the notch 76. With the arcuate walls of the notch 76 positioned about the cylindrical surface of the received plug portion, the recoil spring plug 30 is captured by the notch 76 and the lockplate member 60 is prevented from moving endwise along the through-opening 51. Thus, the lockplate member 60 and recoil spring plug 30 cooperate in a manner locking the lockplate member 60 within the through-opening 51 and so that withdrawal of the lockplate member 60 therefrom requires that the recoil spring plug 30 be depressed to its FIG. 7 rearward position. Such a feature is advantageous in that the lockplate member 60 cannot be accidentally dislodged or shifted endwise out of the through-aperture 51 due to firearm vibrations or other force-generating occurrences which may otherwise urge the lockplate member 60 endwise.

When assembling the firearm 10, the barrel 20 is operatively positioned within the slide 22 and the barrel bushing 24 is positioned about the barrel 20 so that its slot 44 is positioned in registry with the slide through-aperture 34 as shown in FIG. 4. One end of the recoil spring 32 is operatively positioned onto the recoil guide rod 29 (FIG. 2) which is positioned within the slide 22 forward of the barrel lug 26. The recoil spring plug 30 is subsequently depressed onto the forward end of the recoil spring 32 now contained along the length of and in relation to the sleeve-like portion 28 so that the recoil plug 30 is positioned in its FIG. 6 forward position and so that its slot 52 is positioned in registry with the slide through-aperture 34 and bushing slot 44 as shown in FIG. 6. The lockplate member 60 is thereafter inserted endwise within the defined through-opening 51 so that the member 60 is substantially centered between the sides of the slide 22, and the recoil spring plug 30 is thereafter released to move forwardly to its FIG. 7 position to thereby lock the lockplate member 60 within the through-opening 51 and so that withdrawal of the lockplate member 60 out of the through-opening 51 is prevented by notch 76 under pressure of the recoil spring 32.

Disassembly of the aforediscussed components of the firearm locking system 12 requires that the plug 30 be moved from its FIG. 7 forward position to its FIG. 6 rearward position so that the lockplate member 60 can be withdrawn from the through-opening 51. Such rearward movement of the plug 30 can be effected as the forward end of the plug 30 is depressed with a thumb or finger. With the lock plate member 60 withdrawn from the through-opening 51, the bushing 24 can be withdrawn from the barrel slide 22 and the recoil spring plug 30 can be removed from the sleeve-like portion 28 of the slide 22. The lockplate system 12 thus renders the assembly and disassembly of the system components relatively easy and is believed to be advantageous in this respect.

When the slide 22 is forcibly moved from its forward limit of travel to its rearward limit of travel by either a manual forcing of the slide 22 rearwardly for purposes of positioning a cartridge within the barrel 20 or by discharging the firearm 10 so that the explosive forces generated by the discharge suddenly shift the slide rearwardly, the forces required to shift the slide 22 rearwardly are transferred from the slide 22 and barrel bushing 24 to the receiver 14 though the recoil spring plug 30 and recoil spring 32. It follows that such forces are transferred from the slide 22 and barrel bushing 24 to the recoil spring plug 30 by way of the lockplate member 60. More specifically and during the transference of such force from the slide 22 to the recoil spring plug 30, the rearwardly-facing walls 38 and 48 of the through-aperture 34 and bushing 24 bear against the forwardly-facing surface 70 of the lockplate member 60 while the rearwardly-facing surface 78 of the member 60 bears against the forwardly-facing wall 54 of the recoil spring plug 30. The groove 74 defined in the lockplate member 60 provides clearance for the recoil spring 32 as the spring 32 is compressed and extended during the reciprocation of the slide 22.

The locking system 12 is believed to be advantageous in that any likelihood that the components of the system 12 will fail due to shear during the transference of forces from the slide 22 to the recoil spring plug 30 is relatively small. Such a reduction in such a likelihood of shear failure is believed to be due, at least in part, to the planar bearing surfaces through which the slide-moving forces are transferred and to the relatively large area of engagement between the lockplate member 60, barrel bushing 24 and slide 22, and the relatively large area of engagement between the lockplate member 60 and recoil spring plug 30. Further, should such a shear occur, the component parts of the system 12 would be jammed into positions which would still allow the firearm to continue to function, albeit with greatly reduced accuracy and smoothness of operation. Therefore, such a shear would not completely render the firearm disabled.

For exemplary purposes, the following dimensions of the component slots 44, 52, through-aperture 34 and lockplate member 60 are provided here as follows:

The bushing slot 44 has a width as measured between its forwardly and rearwardly-facing walls 46 and 48 of about 0.226 inches and a depth of about 0.054 inches; the recoil spring plug slot 52 has a width as measured between its forwardly and rearwardly-facing walls 54 and 56 of about 0.226 inches and a depth of about 0.023 inches; the through-aperture 34 has a width as measured between the forwardly and rearwardly facing walls 36 and 38 of about 0.227 inches and has a height as measured between the downwardly and upwardly-facing wall 46 of about 0.165 inches; and the lockplate member 60 and is about 0.225 inches wide as measured between its forwardly and rearwardly-facing surfaces 64 and 70 and has a height of about 0.125 inches as measured between its surfaces 66 and 68. Further, the rearwardly-facing surfaces 72 and 78 of the lockplate member 60 are about 0.060 inches apart, the wall of the notch 76 is spaced from the member surface 68 a distance of about 0.056 inches, the groove 74 of the surface 66 is about 0.046 inches deep, the radius of the wall of the groove 74 is about 0.240 inches and the radius of the wall of the notch 76 is about 0.251 inches.

The lockplate system 12 is believed to be still further advantageous in that the components thereof are relatively easy to manufacture. For example, because neither the barrel bushing 24 nor the recoil spring plug 30 requires the inclusion of a projecting lug, as do common conventional firearms, for securement of the barrel bushing and recoil spring plug within the slide, production costs which would otherwise be involved in fabricating such lug-including components are saved.

It will be understood that numerous modifications and substitutions can be had to the aforedescribed embodiment without departing from the spirit of the invention. Accordingly, the aforedescribed embodiment is intended for purposes of illustration and not as limitation.

What is claimed is:

1. In a firearm having a receiver, a barrel slide mounted upon the receiver for reciprocating movement relative thereto between forward and rearward limits of travel, a sleeve-like portion depending from a muzzle end of said slide and reciprocatably received within said receiver, a barrel positioned within the slide, a barrel bushing interposed between the slide and the barrel for movement with the slide during reciprocating movement thereof, a recoil spring connected between the receiver and the slide for urging the slide to its forward limit of travel and a recoil spring plug interposed between the spring and slide so that forces utilized to shift the slide toward its rearward limit of travel are transferred from the slide to the recoil spring and wherein the recoil spring plug is movable forwardly and rearwardly to a limited extent relative to the slide between a rearward position at which disassembly of the firearm is facilitated and a forward position, the improvement comprising:

means defining an aperture that extends transversely of and fully through said slide, said aperture being disposed at a junction of said sleeve-like portion and the muzzle end of said slide, means defining a slot extending transversely of said barrel bushing and opening outwardly of an outer circumference of said bushing, means defining a further slot extending transversely of said recoil spring plug and opening outwardly of an outer circumference of said plug, lockplate means adapted to be received in said aperture, said lockplate comprising elongated body portion of generally rectangular cross-section, means defining a first arcuate cutout disposed centrally of a length of said lockplate and in one side thereof, means defining a second arcuate cutout disposed concentrically of said first cutout, of larger radial dimension than said first cutout, and extending less than fully through a full dimension between opposite surfaces of said lockplate, whereby there is defined an arcuate shoulder between said cutouts, said lockplate, when disposed in said aperture, receiving in said first cutout a portion of said recoil spring with said spring being slidable with respect to said lockplate so that said lockplate does not interfere with compression or expansion of said recoil spring, and receiving in said second cutaway one edge of said further slot defined in said recoil spring plug, a side edge of said lockplate opposite said first arcuate cutout being substantially linear and being received in said slot defined in said barrel bushing, thereby releasably interconnecting said recoil spring plug and said barrel bushing one to another for simultaneous reciprocation of the recoil spring plug and the barrel bushing with said slide and its sleeve-like portion in response to firing of said firearm.

2. The improvement of claim 1 wherein the aperture through the slide has a rearwardly-facing planar wall, the further slot of the recoil spring plug has a forwardly-facing planar wall, and said lockplate means has a planar forwardly-facing surface for receiving slide-shifting forces from the rearwardly-facing wall of the slide and a planar rearwardly-facing surface for transferring slide-shifting forces received from the slide to the forwardly-facing wall of the further slot of the recoil spring plug.

3. The improvement of claim 2 wherein the rearwardly-facing wall of the aperture through said slide engages the forwardly-facing surface of the lockplate means over a first arcuate section thereof, the forwardly-facing wall of the further slot of the recoil spring plug is engaged by the rearwardly-facing surface of the lockplate member over a second arcuate section thereof.

4. The improvement of claim 2 wherein the dimension of said lockplate means as measured between its forward and rearward faces is at least 2.5 times its thickness as measured between its top and bottom surfaces at a location centrally of the length of said lockplate.

* * * * *